US007446659B2

(12) United States Patent
Marsilio et al.

(10) Patent No.: US 7,446,659 B2
(45) Date of Patent: Nov. 4, 2008

(54) THEFT DETERRENT DEVICE WITH DUAL SENSOR ASSEMBLY

(75) Inventors: Ronald M. Marsilio, Lake Wiley, SC (US); Dennis D. Belden, Jr., Waxhaw, NC (US)

(73) Assignee: InVue Security Products Inc., Charlotte, NC (US)

( * ) Notice: Subject to any disclaimer, the term of this patent is extended or adjusted under 35 U.S.C. 154(b) by 95 days.

(21) Appl. No.: 11/331,528

(22) Filed: Jan. 13, 2006

(65) Prior Publication Data

US 2007/0164860 A1 Jul. 19, 2007

(51) Int. Cl.
*G08B 13/14* (2006.01)

(52) U.S. Cl. ..... 340/568.1; 340/568.2; 340/649; 340/664; 340/542; 340/687; 340/508

(58) Field of Classification Search ..... 340/568.1, 340/568.2, 649, 664, 542, 687, 508, 572.1
See application file for complete search history.

(56) References Cited

U.S. PATENT DOCUMENTS

| | | | |
|---|---|---|---|
| 3,127,597 | A | 3/1964 | Lewin et al. |
| 3,253,270 | A | 5/1966 | Downer |
| 3,444,547 | A | 5/1969 | Surek |
| 3,596,265 | A | 7/1971 | Garland |
| 3,932,857 | A | 1/1976 | Way et al. |
| 3,972,039 | A | 7/1976 | Marshall |
| 4,151,521 | A | 4/1979 | Wirth, Jr. |
| 4,211,995 | A | 7/1980 | Smith |
| 4,293,852 | A | 10/1981 | Rogers |
| 4,340,884 | A | 7/1982 | Maizland |
| 4,455,464 | A | 6/1984 | Leyden |
| 4,616,113 | A | 10/1986 | Jank et al. |
| 4,620,182 | A | 10/1986 | Keifer |
| 4,698,615 | A | 10/1987 | Wilber |
| 4,772,878 | A | 9/1988 | Kane |
| 4,896,140 | A | 1/1990 | Biever et al. |
| 5,003,292 | A | 3/1991 | Harding et al. |
| 5,066,942 | A | 11/1991 | Matsuo |
| 5,072,213 | A | 12/1991 | Close |

(Continued)

FOREIGN PATENT DOCUMENTS

EP 0 516 476 12/1992

OTHER PUBLICATIONS

US 5,821,888, 10/1998, Kuhling (withdrawn)

*Primary Examiner*—Tai T Nguyen
(74) *Attorney, Agent, or Firm*—Sand & Sebolt

(57) ABSTRACT

A theft deterrent device allows a customer to handle an item of merchandise to which the device is connected. The device is configured to protect items of merchandise having first and second pieces each of which are sufficiently valuable to warrant such protection. The device includes a base mountable on a support structure, an audible alarm, first and second connectors which attach respectively to the first and second pieces of the item of merchandise, lanyards for connecting the base to the first and second connectors and a removal sensor for sensing removal of one or both of connectors from the first and second pieces of the item of merchandise so that the alarm is activated when the connector or connectors are removed from the item of merchandise. The lanyards provide electrical communication between the alarm and the connectors, which may include plunger switches which serve as removal sensors.

18 Claims, 7 Drawing Sheets

U.S. PATENT DOCUMENTS 5,124,685 A 6/1992 Rankin
5,246,183 A 9/1993 Leyden
5,279,135 A 1/1994 Leyden et al.
5,289,559 A 2/1994 Wilson
5,341,124 A 8/1994 Leyden et al.
5,345,219 A 9/1994 Rogers
5,345,220 A 9/1994 Wachsman
5,408,212 A 4/1995 Meyers et al.
5,418,521 A 5/1995 Read
5,421,667 A 6/1995 Leyden et al.
5,467,075 A 11/1995 Rand
5,543,782 A 8/1996 Rothbaum et al.
5,552,771 A 9/1996 Leyden et al.
5,561,417 A 10/1996 Rothbaum et al.
5,565,848 A 10/1996 Leyden et al.
5,574,430 A 11/1996 Ott et al.
5,796,337 A 8/1998 Wachsman
5,821,857 A 10/1998 Rand
5,861,807 A 1/1999 Leyden et al.
5,888,633 A 3/1999 Adams
5,910,768 A 6/1999 Ott
5,960,651 A 10/1999 Tanisawa
6,027,277 A 2/2000 Leyden et al.
6,037,867 A 3/2000 Joseph et al.
6,039,496 A 3/2000 Bishop
6,039,498 A 3/2000 Leyden et al.
6,072,393 A 6/2000 Todd
6,087,939 A 7/2000 Leyden et al.
6,104,289 A 8/2000 Rand
6,140,923 A 10/2000 Lam
6,147,603 A 11/2000 Rand
6,150,940 A 11/2000 Chapman et al.
6,177,869 B1 1/2001 McDaid
6,215,400 B1 4/2001 Rand et al.
6,278,365 B1 8/2001 Kane et al.
6,285,283 B1 9/2001 Rand et al.
6,300,874 B1 10/2001 Rand
6,337,633 B1 1/2002 Foseide
RE37,590 E 3/2002 Leyden et al.
6,353,389 B1 3/2002 Matsuo
6,380,855 B1 4/2002 Ott
6,386,906 B1 5/2002 Burke
6,396,401 B1 5/2002 Matsuo
6,459,374 B1 10/2002 Rand et al.
6,462,668 B1 10/2002 Foseide
6,476,717 B1 11/2002 Gross et al.
6,560,710 B1 5/2003 Leyden et al.
6,570,502 B2 5/2003 Matsuo
6,581,421 B2 6/2003 Chmela et al.
2004/0229498 A1* 11/2004 Fort et al. ..... 439/502
2007/0152819 A1* 7/2007 Marszalek et al. ..... 340/568.4

* cited by examiner

THEFT DETERRENT DEVICE WITH DUAL SENSOR ASSEMBLY

BACKGROUND OF THE INVENTION

1. Technical Field

The present invention relates generally to theft deterrent devices for retail establishments. More particularly, the invention relates to a security device which attaches to an item of merchandise. Specifically, the invention relates to such a security device which attaches to an item of merchandise which having two pieces each of which are protected by the security device.

2. Background Information

Retail stores have had a difficult time in protecting items of merchandise which the potential customer wishes to visually inspect and handle prior to making the decision to purchase the item. Often, such items of merchandise have been kept in a glass case under lock and key, which does not allow the customer to handle the item without the assistance of store personnel. In addition, while such items may be secured to a foundation or base by a cable or the like, this does not necessarily prevent the theft of the item by the cutting of the cable. Thus, there is a need in the art for security devices which allow for the handling of the item and which will alarm should someone try to steal the item. Certain items of merchandise have two pieces which are removable connected to one another and each of which are sufficiently valuable for the retailer to desire protection against theft of either piece of the merchandise.

BRIEF SUMMARY OF THE INVENTION

The present invention provides a theft deterrent device comprising a base adapted to mount on a support structure; an audible alarm; a first connector movable between attached and removed positions; wherein the first connector is adapted to attach to a first piece of an item of merchandise in the attached position and be removed there from in the removed position; a second connector movable between attached and removed positions; wherein the second connector is adapted to attach to a second piece of the item of merchandise in its attached position and be removed there from in its removed position; at least one lanyard for connecting the base to each of the first and second connectors; at least one removal sensor for sensing movement of at least one of the first and second connectors from its respective attached position to its respective removed position; wherein the alarm is activated when the at least one connector moves from its respective attached position to its respective removed position.

The present invention further provides a security device comprising a base adapted to mount on a support structure; an audible alarm; a first connector movable between attached and removed positions; wherein the first connector is adapted to attach to a first piece of an item of merchandise in the attached position and be removed there from in the removed position; a second connector movable between attached and removed positions; wherein the second connector is adapted to attach to a second piece of the item of merchandise in its attached position and be removed there from in its removed position; at least one lanyard which provides electrical communication between the alarm and each of the first and second connectors; wherein movement of one of the first and second connectors from its respective attached position to its respective removed position activates the alarm.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
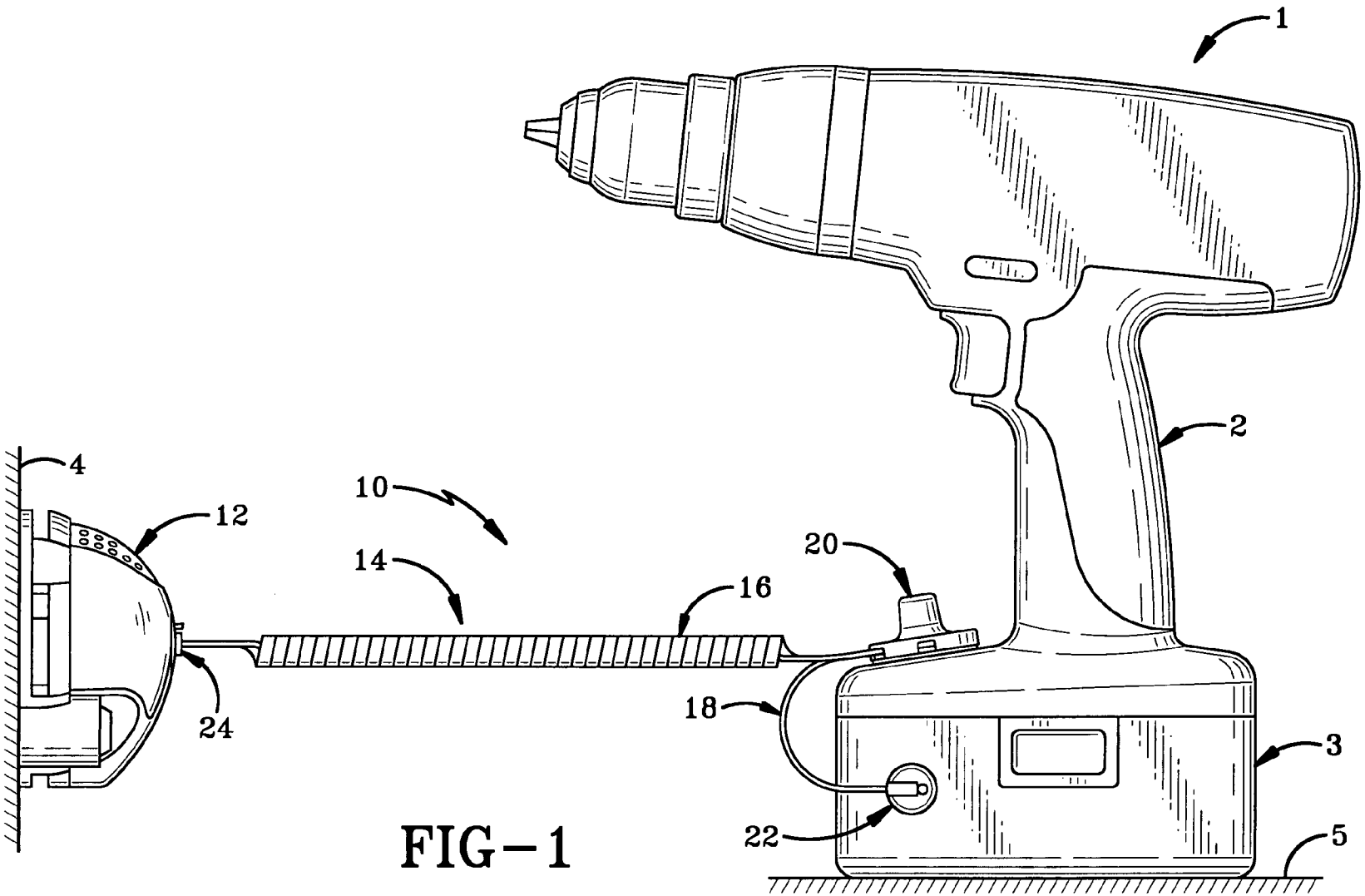
FIG. 1 is a side lavational view of a first embodiment of the present invention attached to a battery powered drill.
Figure 2:
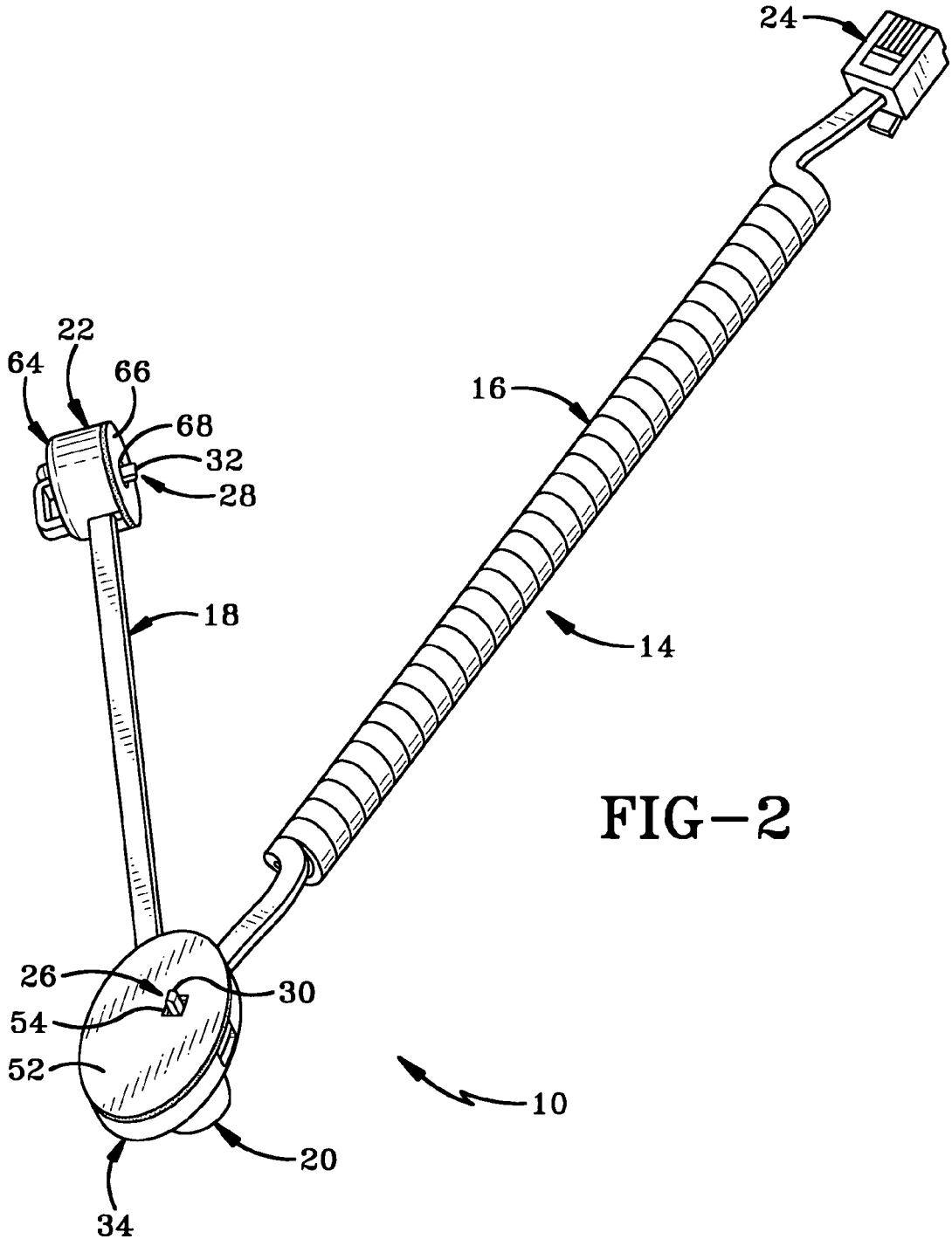
FIG. 2 is a perspective view of the lanyard assembly of the first embodiment.
Figure 6:
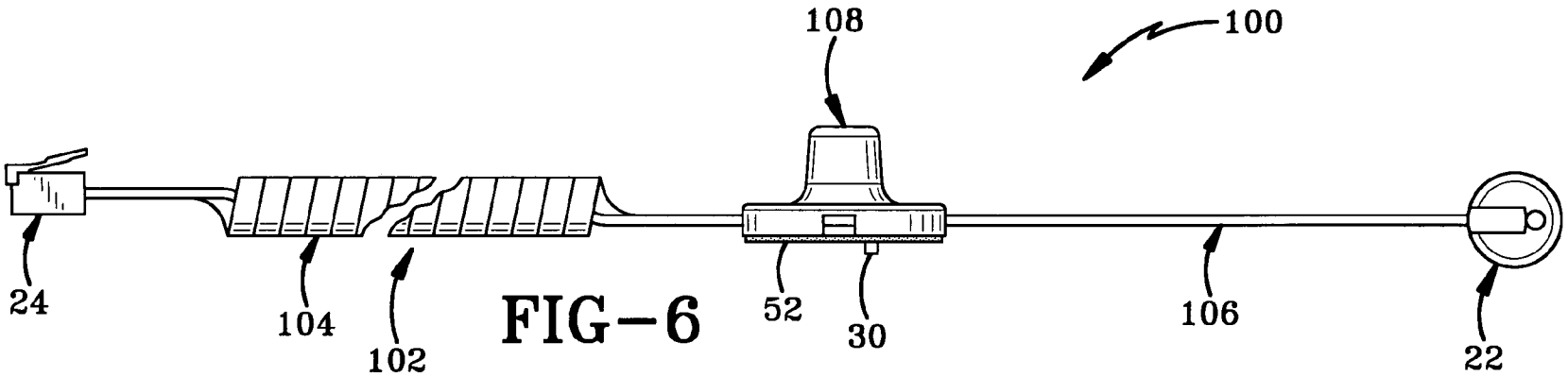
FIG. 6 is a side view of a second embodiment of the lanyard assembly of the present invention with portions cut away.
Figure 9:
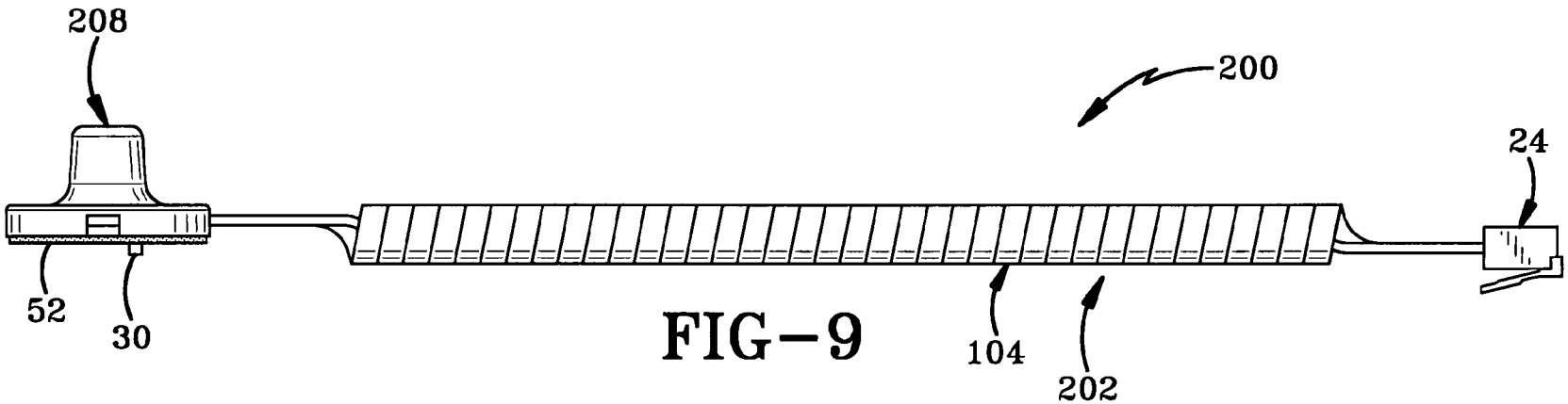
FIG. 9 is a side view similar to FIG. 6 showing a third embodiment of the lanyard assembly of the present invention.

A first embodiment of the security device of the present invention is indicated generally at 10 in FIGS. 1 and 2; a second embodiment is indicated generally at 100 in FIG. 6; and the third embodiment is indicated generally at 200 in FIG. 9. Referring to FIG. 1, device 10 is shown mounted on an item of merchandise 1 in the form of a battery powered drill which has first and second pieces 2 and 3. First piece 2 is more particularly the drill body and second piece 3 is the rechargeable battery which provides power to body 2 in order to operate drill 1. First and second pieces 2 and 3 are removable connected to one another and are sufficiently valuable to make it desirable to protect each piece 2 and 3 from theft. Device 10 is configured to set off an alarm should the theft of either piece 2 and 3 be attempted.

Device 10 includes an alarming station or member 12 which is securely mounted on a wall or other support structure 4. Alarming member 12 is described in co-pending provisional patent application having Ser. No. 60/644,206, the contents of which are incorporated herein by reference. Item 1 of merchandise is seated on a display surface 5. A lanyard assembly 14 is connected to each of alarm member 12 and item 1 of merchandise.

With reference to FIGS. 1 and 2, lanyard assembly 14 includes first and second lanyards 16 and 18 and first and second connectors 20 and 22. First lanyard 16 is in the form of an alarming cable which is connected to alarm member 12 via a removable plug 24 and to first connector 20, which is shown attached in FIG. 1 to first piece 2 of item 1 of merchandise. Second lanyard 18 extends between and is connected to first and second connectors 20 and 22. Second connector 22 is shown in FIG. 1 attached to second piece 3 of item 1 of merchandise. In the exemplary embodiment, first and second connectors 20 and 22 are attached to first and second pieces 2 and 3 via an adhesive although other attachment mechanisms may be used. An adhesive connection provides a mechanism for preventing marring of the item of merchandise while allowing the item to be handled easily by the potential customer.

Referring to FIG. 2, first and second connectors 20 and 22 have respective removal sensors 26 and 28 in the form of plunger switches having respective first and second plungers 30 and 32 which are shown in an extended, non-depressed or removed position associated with being removed from item 1 of merchandise. When either one of plungers 30 and 32 are in the extended or removed position, alarm 12 will emit an audible alarm. However, alternate removal sensors may be utilized in place of plunger switches 26 and 28. Thus, device 10 is configured so that first and second connectors 20 and 22 attach to pieces 2 and 3 of item 1 of merchandise in a reasonably secure manner, but without being locked thereto. Thus, in the exemplary embodiment, there is no locking mechanism for locking device 10 to item 1 of merchandise and thus no key for the removal thereof. Thus, while connectors 20 and 22 may be pried off of item 1 of merchandise with some difficulty, the result is the sounding of the alarm of alarm member 12.

Figure 3:
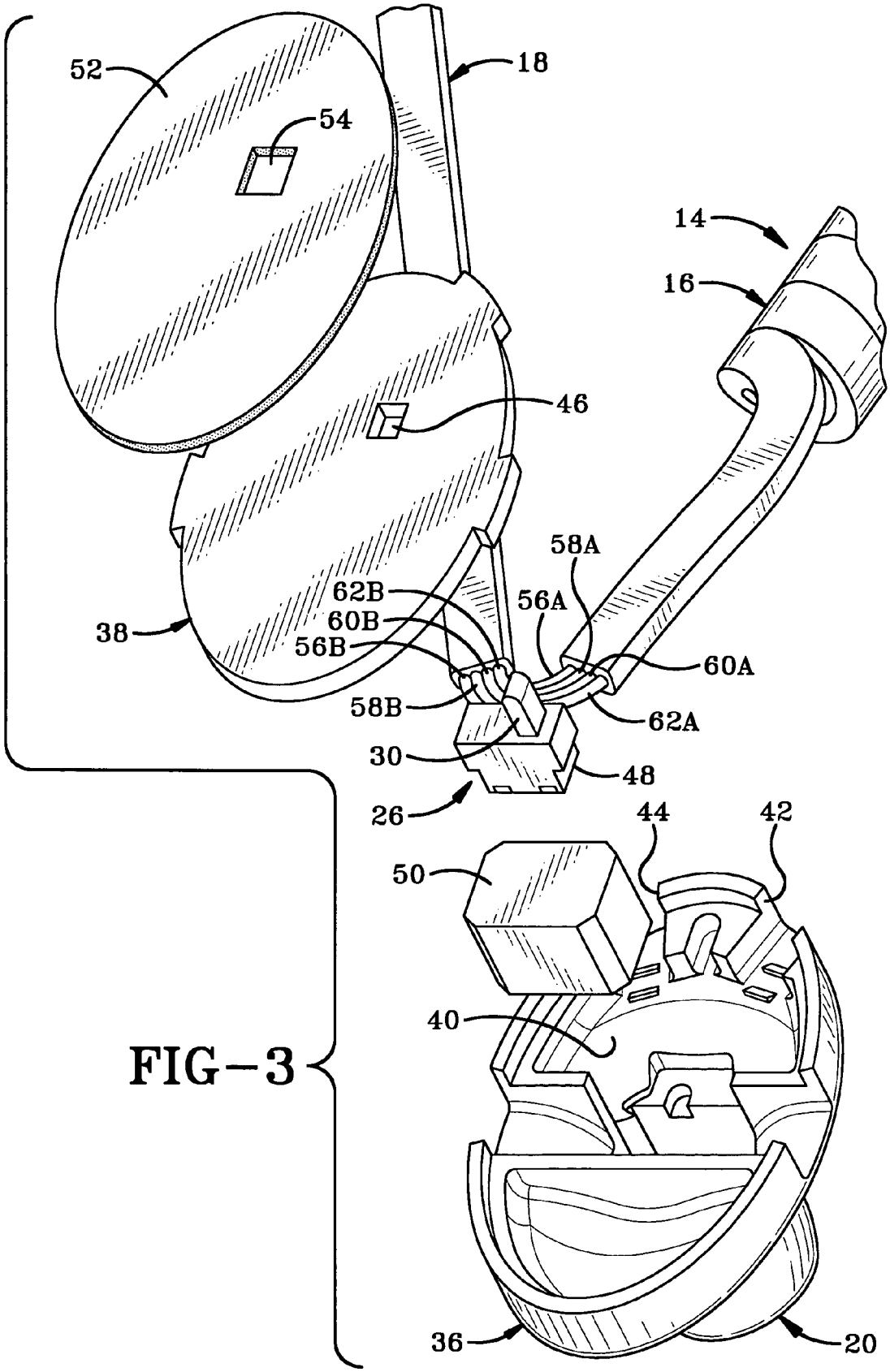
FIG. 3 is an exploded perspective view of a portion of the lanyard assembly showing the first connector disassembled.
Figure 4:
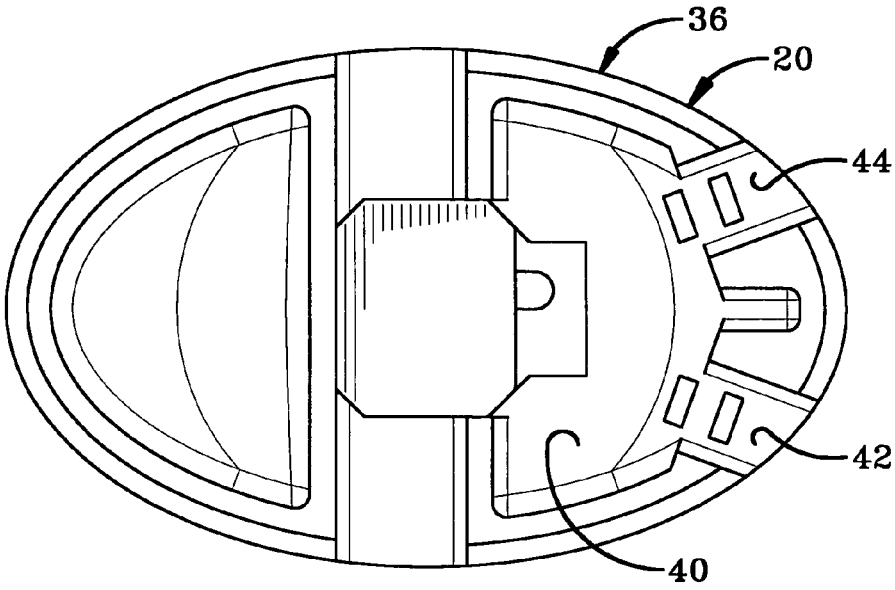
FIG. 4 is a bottom plan view of first connector of the first embodiment with the bottom wall removed.

Referring to FIGS. 2 and 3, first connector 20 includes a housing 34 comprising first and second housing members 36 and 38. First housing member 36 defines an interior chamber 40 and first and second entrance openings 42 and 44 which communicate therewith. Second housing member 38 is in the form of a substantially flat oval-shaped bottom wall which is securely mounted to first housing member 36. Second housing member 38 defines an opening 46 for receiving plunger 30 of switch 26 there through. Interior chamber 40 of first housing member 36 is configured to receive a body 48 of switch 26 with portions of first and second lanyards 16 and 18 extending respectively through first and second entrance openings 42 and 44. Interior chamber 40 is also configured to receive other related structures such as structure 50 which may be for example, a magnet or an electronic article surveillance (EAS) tag. Use of an EAS tag may allow for the sounding of an alarm other than alarm member 12 should alarm member 12 somehow be nonfunctional. First connector 20 further includes a mounting mechanism in the form of an adhesive pad 52 which defines an opening 54 for receiving there through plunger 30 of switch 26. Second connector 22 likewise has a housing 64 and an adhesive pad 66 which defines an opening 68 for receiving there through plunger 32 of switch 28. Second connector 22 is thus adhered to second piece 3 of the item of merchandise via adhesive pads 66. As seen in FIGS. 3 and 4, entrance openings 42 and 44 are disposed adjacent one end of first housing member 36 so that first and second lanyards 16 and 18 extend generally from that end of housing member 36.

Alarming cable 16 includes four wires 56A, 58A, 60A and 62A. Second alarming cable 18 likewise includes four wires 56B, 58B, 60B and 62B which may or may not be continuous with wires 56A-62A of first cable 16. These wires provide respective electrical communication between plug 24 and each of switches 26 and 28 to form respective electrical circuits which are either open or closed when plungers 30 and 32 are respectively depressed.

Figure 5:
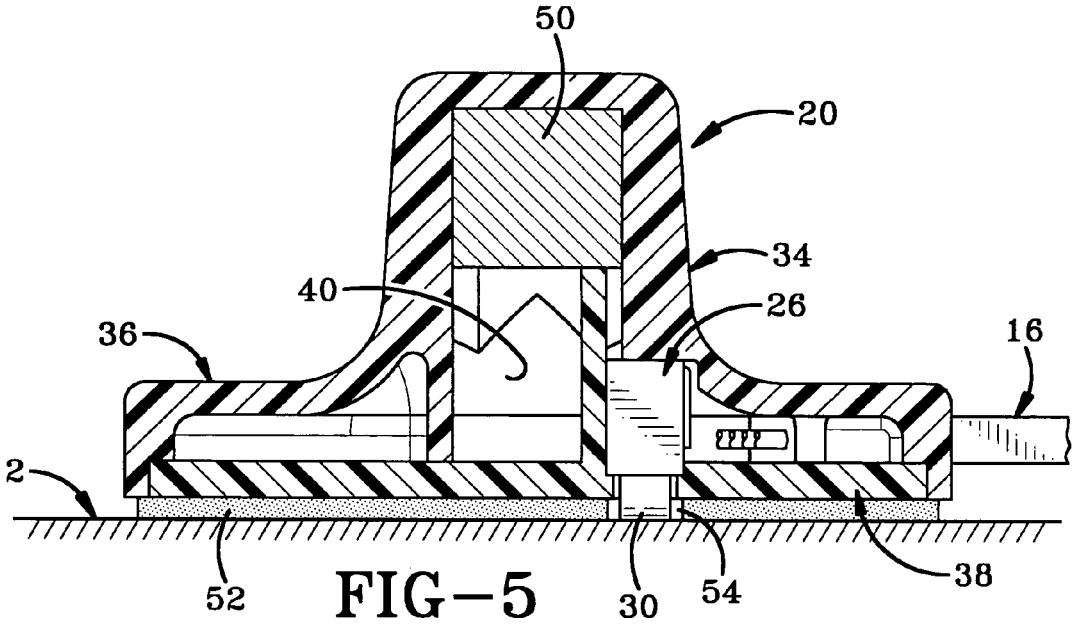
FIG. 5 is a sectional view of the first connector of the first embodiment taken from the side.

Device 10 is thus configured to sound an alarm of alarm member 12 if a potential thief attempts to steal either piece 2 and 3 of item 1 of merchandise by removing either of first and second connectors 20 and 22 from said pieces 2 and 3. More particularly, when plunger 30 of switch 26 is in a depressed position associated with the attached position of member 20 on first piece 2 of the article of merchandise (FIGS. 1 and 5), alarm member 12 will not sound an alarm. Second switch 28 of second connector 22 is likewise configured. Removal of either of first and second connectors 20 and 22 will respectively allow plunger 30 and 32 to extend and thus either open or close the respective electrical circuit which will cause alarm member 12 to sound an alarm. These circuits may be sense loops which if compromised cause the alarm of alarm member 12 to sound. For example, if plug 24 is removed from alarm member 12 or if one of lanyards 16 and 18 is severed, alarm member 12 will sound the alarm. In addition, as previously noted, should alarm member 12 somehow be nonfunctional, an EAS tag 50 or the like may allow for the sounding of an alarm should a connector 20 or 22 carrying such a tag remain attached to the item as it moves near or through a security gate. These various alarming characteristics and in particular used with a security gate are described in greater detail in co-pending patent application entitled Electronic Security Device and System for Article of Merchandise, filed on or about Dec. 20, 2005, the contents of which are incorporated herein by reference. Said application claims priority from provisional patent application having Ser. No. 60/639,770, filed on Dec. 28, 2004, the contents of which are also incorporated herein by reference.

Figure 7:
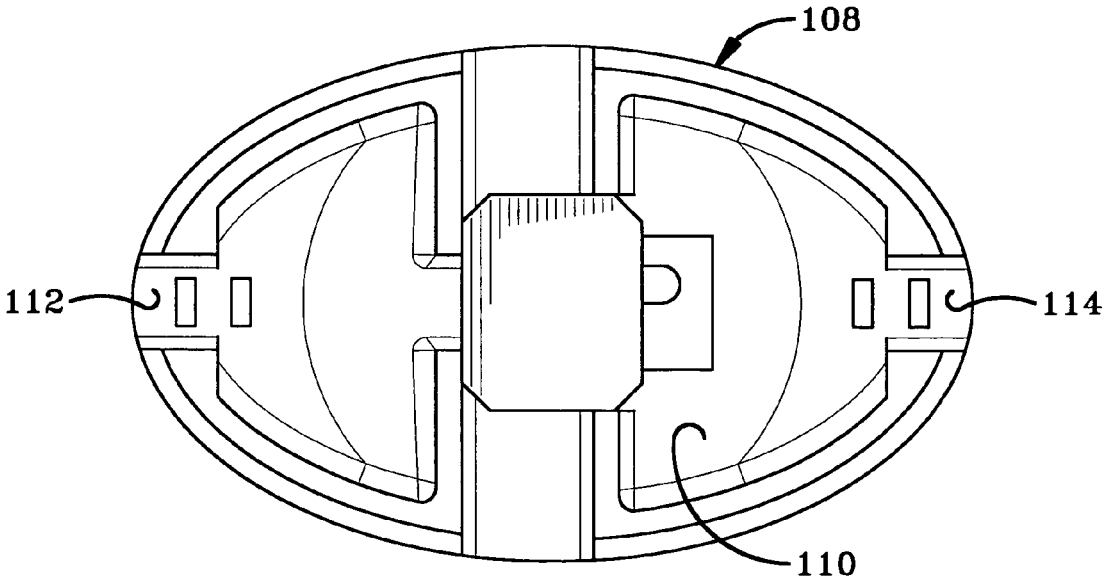
FIG. 7 is a bottom plan view similar to FIG. 4 showing the first connector of the second embodiment.
Figure 8:
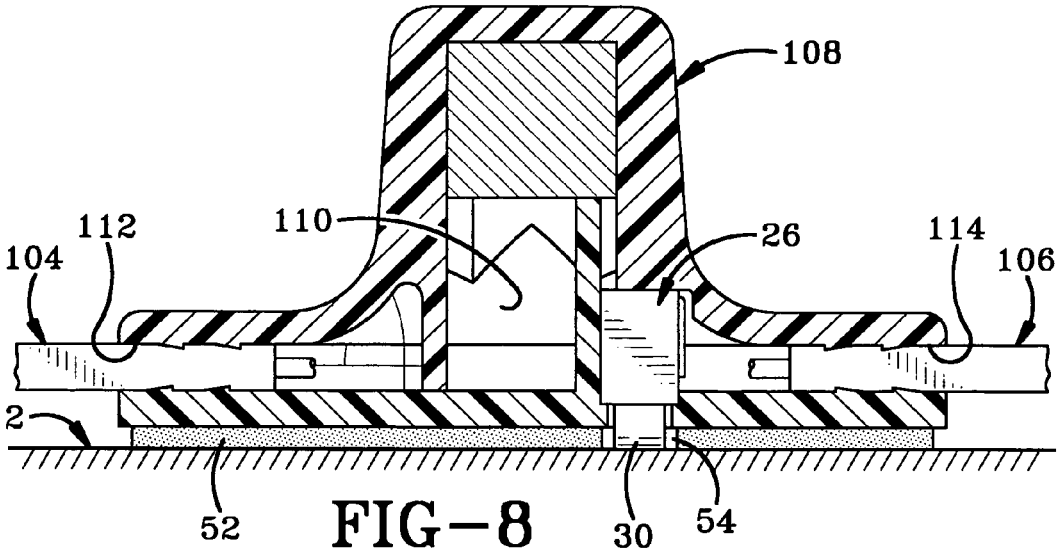
FIG. 8 is a sectional view similar to FIG. 5 of the first connector of the second embodiment.

With reference to FIGS. 6-8, security device 100 is described. Security device 100 is similar to security device 10 and operates in the same manner except that it has a lanyard assembly 102 which varies from lanyard assembly 14 of device 10. More particularly, lanyard assembly 102 includes first and second lanyards 104 and 106 which are similar to lanyards 16 and 18. In addition, assembly 102 includes a first connector 108 and second connector 22. The primary distinction between lanyard assembly 102 and lanyard assembly 14 is that assembly 102 allows for first and second lanyards 104 and 106 to extend from opposite ends of first connector 108. To that effect, first connector 108 defines an interior chamber 110 and first and second entrance openings 112 and 114 which communicate therewith and are formed on opposite ends of connector 108. First and second entrance openings 112 and 114 respectively receive portions of first and second lanyards 104 and 106 which are in electrical communication with switch 26 mounted within interior chamber 110. One skilled in the art will appreciate that the wiring configuration of lanyards 104 and 106 may vary as required in order to provide the electrical communication which provides the alarming characteristics described with respect to device 10.

Figure 10:
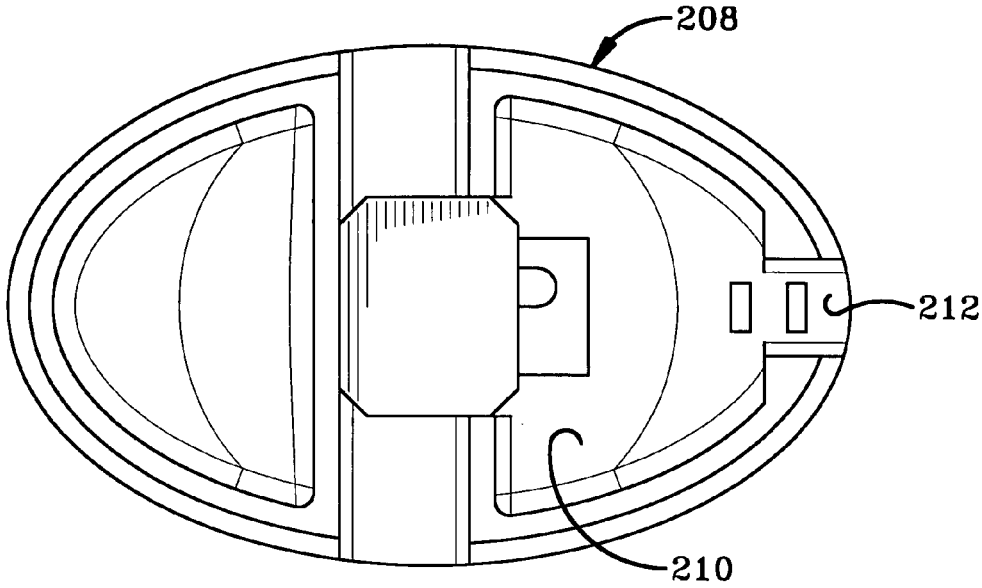
FIG. 10 is a bottom view similar to FIGS. 4 and 7 showing the connector of the third embodiment.
Figure 11:
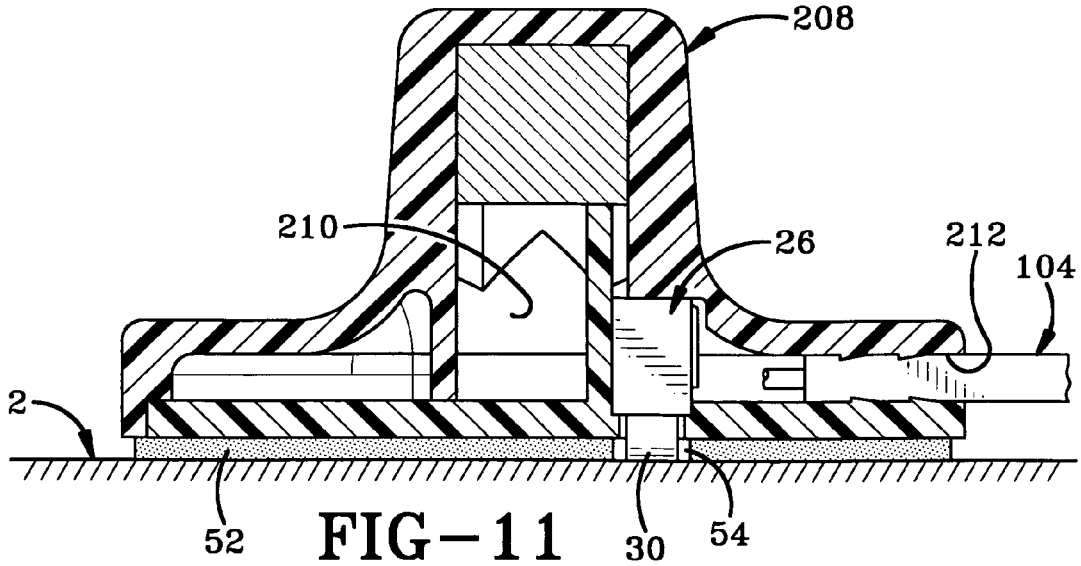
FIG. 11 is a sectional view similar to FIGS. 5 and 8 of the connector of the third embodiment.

With reference to FIGS. 9-11, security device 200 is described. Device 200 is similar to devices 10 and 100 except that it utilizes a single connector for attaching to an item of merchandise. More particularly, device 200 includes a lanyard assembly 200 which utilizes a single lanyard 104 and a single connector 208. Connector 208 is similar to connectors 20 and 108 except for it defines an interior chamber 210 having a single entrance opening 212 for receiving therein a portion of lanyard 104 to provide electrical communication between switch 26 and plug 24. Security device 200 thus is configured to attach to an item of merchandise at one location instead of the two locations provided by the first and second connectors of devices 10 and 100. However, devices 200 similarly provides the removal sensor in the form of plunger switch 26 which provides for the sounding of alarm member 12 should connector 208 be removed from the item of merchandise.

In the foregoing description, certain terms have been used for brevity, clearness, and understanding. No unnecessary limitations are to be implied there from beyond the requirement of the prior art because such terms are used for descriptive purposes and are intended to be broadly construed.

Moreover, the description and illustration of the invention is an example and the invention is not limited to the exact details shown or described.

The invention claimed is:

1. A theft deterrent device comprising:

a base adapted to mount on a support structure;

an audible alarm;

a first connector movable between attached and removed positions; wherein the first connector is adapted to attach to a first piece of an item of merchandise in the attached position and be removed therefrom in the removed position;

a second connector movable between attached and removed positions; wherein the second connector is adapted to attach to a second piece of the item of merchandise in its attached position and be removed therefrom in its removed position;

at least one lanyard for connecting the base to each of the first and second connectors; wherein the at least one lanyard includes a first lanyard extending between and connected to the base and the first connector; and a second lanyard extending between and connected to the first connector and the second connector;

at least one removal sensor for sensing movement of at least one of the first and second connectors from its respective attached position to its respective removed position;

wherein the alarm is activated when one of the connectors moves from its respective attached position to its respective removed position.

2. The device of claim 1 wherein the at least one removal sensor is connected to one of the first and second connectors.

3. The device of claim 2 wherein the at least one removal sensor includes a first removal sensor connected to the first connector for sensing movement of the first connector from its attached position to its removed position and a second removal sensor connected to the second connector for sensing movement of the second connector from its attached position to its removed position.

4. The device of claim 1 wherein the removal sensor includes at least one plunger switch which is connected to one of the first and second connectors and has a plunger which is movable between depressed and non-depressed positions associated respectively with the attached and removed positions of the one of the connectors.

5. The device of claim 4 wherein the at least one plunger switch includes first and second plunger switches which are respectively connected to the first and second connectors.

6. The device of claim 4 wherein the at least one plunger switch is in electrical communication with the alarm via the at least one lanyard.

7. The device of claim 1 wherein the alarm is connected to the base.

8. The device of claim 1 wherein each of the first and second connectors is in electrical communication with the alarm via the lanyards.

9. The device of claim 1 wherein the at least one removal sensor includes a first removal sensor connected to the first connector for sensing movement of the first connector from its attached position to its removed position and a second removal sensor connected to the second connector for sensing movement of the second connector from its attached position to its removed position.

10. The device of claim 9 wherein each of the removal sensors includes at least one plunger switch having a plunger which is movable between depressed and non-depressed positions associated respectively with the attached and removed positions of the respective connector.

11. The device of claim 1 wherein the at least one lanyard provides electrical communication between the alarm and the first connector.

12. The device of claim 11 wherein the at least one lanyard provides electrical communication between the alarm and each of the first and second connectors.

13. The device of claim 1 wherein the alarm is activated if the at least one lanyard is severed.

14. The device of claim 1 wherein the alarm is activated if the at least one lanyard is disconnected from the base or connectors.

15. The device of claim 1 wherein the first and second connectors each include an adhesive pad whereby the first and second connectors are adapted to attach respectively to the first and second pieces of the item of merchandise.

16. The device of claim 1 in combination with the item of merchandise; wherein the first connector in its attached position is attached to the first piece of the item of merchandise; and wherein the second connector in its attached position is attached to the second piece of the item of merchandise.

17. The combination of claim 16 wherein the first and second pieces of the item of merchandise are removably connected to one another.

18. The combination of claim 17 wherein the at least one lanyard includes a first lanyard extending between and connected to the base and the first connector; and a second lanyard extending between and connected to the first connector and the second connector; and wherein the second lanyard has length sufficient to allow the first and second pieces to be removed from one another while connected to the first and second connectors.

* * * * *